US005884787A

United States Patent [19]

Quintard et al.

[11] Patent Number: 5,884,787

[45] Date of Patent: Mar. 23, 1999

[54] CHILD RESISTANT SAFETY CLOSURE

[75] Inventors: Daniel Quintard, Chambourey; William James Lloyd, Croissy-sur-Selne, both of France

[73] Assignee: Colgate-Palmolive Company, New York, N.Y.

[21] Appl. No.: 710,475

[22] Filed: Sep. 18, 1996

[51] Int. Cl.[6] ..... B65D 50/04

[52] U.S. Cl. ..... 215/216; 217/217

[58] Field of Search ..... 215/216, 217, 215/218, 219, 221, 223, 329, 330, 331

[56] References Cited

U.S. PATENT DOCUMENTS

| | | | |
|---|---|---|---|
| 2,752,060 | 6/1956 | Martin | 215/217 X |
| 2,827,193 | 3/1958 | Martin | 215/217 |
| 3,233,769 | 2/1966 | Jessop | 215/217 X |
| 3,376,991 | 4/1968 | Deaver . | |
| 3,399,796 | 9/1968 | Steiner . | |
| 3,841,514 | 10/1974 | Montgomery . | |
| 3,881,624 | 5/1975 | Dougherty . | |
| 3,917,097 | 11/1975 | Uhlig . | |
| 3,941,268 | 3/1976 | Owens et al. | 215/218 X |
| 3,984,021 | 10/1976 | Uhlig | 215/217 X |
| 3,989,152 | 11/1976 | Julian | 215/216 |
| 4,117,945 | 10/1978 | Mumford | 215/216 |
| 4,134,513 | 1/1979 | Mumford . | |
| 4,213,534 | 7/1980 | Montgomery . | |
| 4,270,664 | 6/1981 | Buono . | |
| 4,351,442 | 9/1982 | Summers | 215/216 |
| 4,383,618 | 5/1983 | Dougherty | 215/216 |
| 4,436,211 | 3/1984 | Gach . | |
| 4,723,669 | 2/1988 | Barriac | 215/216 X |
| 5,078,288 | 1/1992 | Fuchs . | |
| 5,238,130 | 8/1993 | Marques et al. | 215/217 X |

FOREIGN PATENT DOCUMENTS

| | | | |
|---|---|---|---|
| 0 299 886 | 1/1989 | European Pat. Off. . | |
| 2486502 | 1/1982 | France | 215/216 |
| 2515565 | 11/1975 | Germany | 215/216 |
| 7514515 | 6/1977 | Netherlands . | |
| 620649 | 12/1980 | Switzerland . | |
| 1524395 | 9/1978 | United Kingdom . | |
| 2030970 | 4/1980 | United Kingdom | 215/216 |
| 2218694 | 11/1989 | United Kingdom . | |

OTHER PUBLICATIONS

PCT Search Report.

*Primary Examiner*—Allan N. Shoap
*Assistant Examiner*—Nathan Newhouse
*Attorney, Agent, or Firm*—Michael McGreal

[57] ABSTRACT

The child resistant safety closure is one that uses a common single start thread on the neck of a container and on a closure. In conjunction with this single start thread there is a single mating projection on the neck and on the closure. These mating projections are in an interference fit until the closure is distorted so that the closure bows outwardly in the region of the projections whereby the projection on the neck and the projection on the closure can pass by one another. The distortion is enhanced by having the plastic of the closure in the area of the projection of a decreased thickness and the neck having flattened portions to provide for a easy distortion of the closure. By the use of a single start common thread and one projection the same closure can be used for containers requiring a safety closure and those not requiring a safety closure. The difference will solely be in the neck finish of the container or on the inner surface of the closure. When the container is to have a safety closure the neck finish has a projection to mate with a projection on the closure. In the instance where the container is not to have a child resistant safety closure either the closure will not have a projection or the neck of the container will not have a projection. In such a case the closure can be freely removed from the container.

11 Claims, 3 Drawing Sheets

CHILD RESISTANT SAFETY CLOSURE

BACKGROUND OF THE INVENTION

This invention relates to a child resistant safety closure for a neck of a container. More particularly, this invention relates to a child resistant safety closure for a container that has a common single start thread, the closure having a structure that is easily deformed for clearance over a locking projection.

There is a constant need for child resistant closures that can easily be opened by adults, and in particular, closures that can be opened easily by elderly adults, but yet cannot be easily opened by young children. In this regard, there must not be a requirement of a vigorous twisting motion or of a strong squeezing in combination with a twisting. The reason is that many people through injury or disease, such as arthritis, have difficulty in gripping and/or twisting a closure to remove the closure from the container. On the other hand, the closure must not be easily removable by a small child. These are two competing requirements that must be considered in the design of a child resistant safety closure.

This problem has been addressed in various ways in the prior art. In U.S. Pat. No. 3,376,991 there is shown a bottle where the container has more of a rectangular shaped dispensing neck. This permits the closure to be flexed inwardly at these points so that the closure at a point about 90° from the point where pressure is applied will bow outwardly. This then permits closure projections on the inner surface of the closure and spout projections on an outer surface of the spout to clear each other and the closure can be removed from the spout in a twisting action. A related structure is disclosed in U.S. Pat. No. 3,841,514. In this closure, there is an inner skirt on the closure for threaded attachment to a container neck and a flexible outer skirt that has a locking arrangement. The outer skirt also has slots that allow for a greater flexing of the outer wall during squeezing and opening. By squeezing the outer flexible skirt the outer skirt is distorted in shape so that locking projections are released and the closure can be removed. U.S. Pat. No. 3,984,021 discloses a closure for a bottle where the bottle neck has two flattened areas. Locking projections are located about 90° from these flattened areas. There are two locking projections and two flattened areas. When the closure is pressed in the area of the flattened areas of the neck, the closure in the area of the projections protrudes outwardly to release the locking mechanism.

These are interesting closures but they have disadvantages. There is yet a very high squeeze pressure needed to release the closure. That is, it takes too much force to deflect the walls of the closure to release the locking mechanism. Further, there is no need for a dual locking mechanism. That is, there is not a need for two projection locking means 180° apart. A single locking means would suffice. The use of a single locking means allows for the use of single start threads, which are also known as common threads since they are used on most containers. The use of single start threads increases the utility of the closure and container. The same container can be used for child resistant safety use and regular use by using a container with a child resistant feature and a closure with or without a child resistant feature as needed. In the alternative the same closure can be used for standard containers not using a child resistant safety closure and containers which use a child resistant safety closure. For a child resistant safety closure requirement there would be a child resistant feature such as a projection on the outer surface of the container neck to interact with a mating projection on the inner surface of the closure. When a safety closure is not required there would not be the projection on the neck of the container or on the closure. One of these projections would be deleted. In a preferred embodiment it is preferred that the projection on the closure be deleted. The same container then would be used in all instances with one closure when child resistance is desired and another closure when it is not desired. In this latter instance, the closure can be freely removed from the container.

BRIEF DESCRIPTION OF THE INVENTION

The child resistant safety closure of the present invention is one which utilizes a single start thread, a single locking projection on the container in the region of the neck, and a single locking projection on the closure. A single start thread is one that has only one thread start in a 360° turn of the closure on the neck of the container. This is in contrast to prior art safety closures which have two locking projections on the neck region and two cooperating locking projections on the closure. The latter will have a double start thread where the thread will start twice in a 360° turn (at each 180° interval) so that the closure will rise at a faster rate on the threads to clear the projections in a half turn. The closure can rise at double the rate of a single start thread.

The advantage of the use of a single start thread and a single set of cooperating projections is that the same thread finish on the container can be used for a child resistant safety closure or for a regular non-safety closure. The only difference in use as a regular closure is that the locking projection on the container or on the closure is eliminated. The thread finish on the neck of the container remains the same as does the thread finish in the safety closure. By the elimination of the projection on the container neck or on the closure the closure can be freely rotated and removed. However when this projection is not eliminated there are mating projections and a safety closure.

In the use of a single start common thread only one cooperating locking projection on the container and on the closure is used since the vertical rise of the single start thread is only about one half that of a double start thread. A closure with a single start thread would not clear a second locking projection on the neck finish of the containers in 180 degrees of travel without a second squeezing release action. That is the closure would have to be squeezed twice to remove it from the container, if in the usual case the release action is a squeezing action. This is not acceptable to consumers.

Consumers would not want to squeeze a closure to release its lock onto a container, rotate it about 180°, squeeze the closure again to release its lock on the container, and to again rotate the closure to fully remove it from the container. There has to be a single squeezing action to release the closure from the container.

Other features of the child resistant safety closure are the thinning of the closure in the area of the closure locking projection and the flattening of the container neck in the area where the closure is squeezed. This flattening of the container neck nominally is 90° from the projection on the container neck. This flattening of the container neck, and the thinning of the closure in the area of the closure locking projection facilitates the squeezing of the closure and clearance of the cooperating projection on the container neck and on the closure. The net result is a closure that, with the same thread finish on the container can be used with a child resistant safety closure or with a standard non-safety closure.

DETAILED DESCRIPTION OF THE INVENTION

As has been discussed, the present invention is directed to the use of a single start thread in conjunction with a child resistant safety closure. A single start thread is one that has a single starting point on the thread in 360° of the surface of the container neck and the inner surface of the closure. A double start thread is one that has two starting points in 360° of the surface of the container neck and the closure. Each thread start is about 180° apart. A two thread start will raise the closure from the spout about double the distance of a single start thread per revolution of the closure. A two thread start will provide greater lift per revolution while maintaining an acceptable closure stability. In a safety closure this greater lift of the closure from the container neck will allow the mating closure locking means to clear the container locking means on the neck in less than a full 360 degree turn of the closure. In this way, one squeezing action is all that is needed to remove the closure from the container. Once the locking means are released the closure can be unthreaded from the container.

In the use of a single thread start on the neck and on the closure only one locking means will be on the container neck and on the closure. In most instances this will be comprised of a single projection on each of the container neck and on the closure. However, it also can consist of a projection and a recess where one of the neck and the closure has a projection or a recess. By the use of a single locking means in a single full rotation of the closure in removing the closure, the single start thread will raise the closure above the locking means. There need only be a single release of the locking means. If the prior art locking structure of FIG. 1 were to be used with a single start thread there would have to be two unlocking operations. That is, there would have to be a squeeze, a twisting, a second squeeze, and a further twisting to remove the closure. This is needed since in a half turn the closure projections would not be clear of the neck projections. After a half turn with a single start thread there would have to be a second unlocking action, such as a squeezing.

Figure 1:
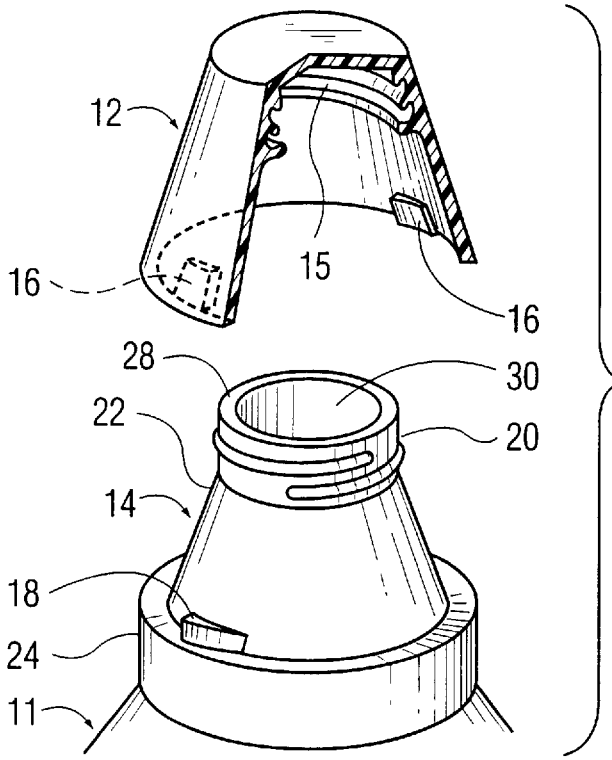
FIG. 1 (PRIOR ART)
FIG. 1 is a drawing of a prior art safety closure which uses dual projections on the container and on the closure and has a double start thread.

In FIG. 1 there is disclosed a prior art child resistant safety closure with two locking means and a double start thread. Bottle 11 has a shoulder 24 and a neck 14. The neck has a tapered surface 22 which terminates in double start threads 20. The container has a top edge 28 and an aperture 30 for dispensing. Closure 12 fits down onto and closes neck 14. The closure has double start threads 15 and locking projections 16. These locking projections 16 interlock with projections 18 on the neck. There is a second projection 18 located 180° on the other side of the neck. In this container neck and closure arrangement if a single start thread is used there will have to be two unlocking operations. There will have to be a squeezing to unlock, a twisting, a second squeezing to unlock and a further twisting to fully remove the closure. A dual unlocking operation is not acceptable. In the prior art this was solved through the use of a double start thread.

Figure 2:
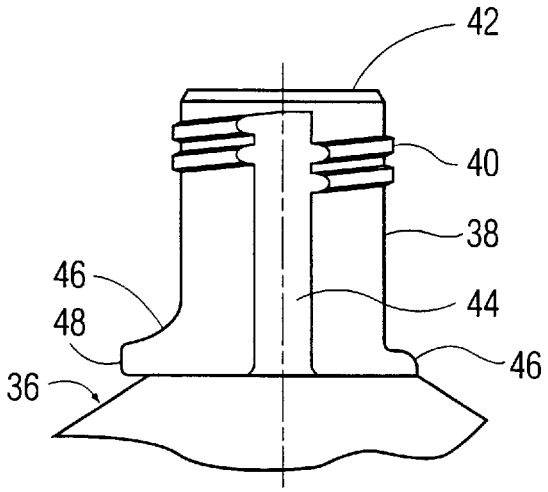
FIG. 2 is a view of an upper part of a container showing a neck region with a single start thread and a single projection.

In FIG. 2 there is disclosed a container neck that conforms to the present invention. Container 36 has a neck 38 with single start thread 40 on the upper part of the neck. This single start thread surrounds said neck about 1.5 to 4 times, and preferably about 1.75 to 3 times. In each 360 degree revolution of the closure on the threads 40 on the neck of the container the closure is raised about 2 to 6 mm, and preferably about 1 to 5 mm. Aperture 42 is located on the end of the neck. At the transition of the neck to the container there is a shoulder 46. One part of shoulder 46 carries projection 48. This is a projection located at one point in the 360° surface of the shoulder. A flattened area 44 of the neck 38 assists in the removal of the closure. There is a flattened area 44 on each side of the neck at a spacing of about 180 degrees. These flattened areas permit the closure to be flexed inwardly to a greater degree at these points so that it will more easily pass over the projection 48 during removal.

Figure 3:
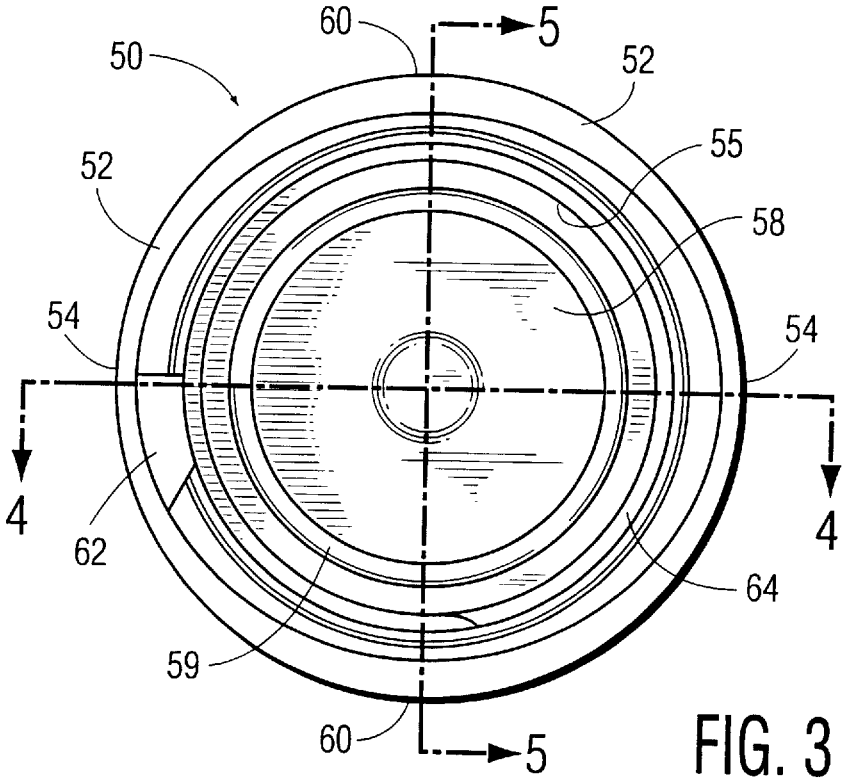
FIG. 3 is a bottom plan view of the closure with a single projection and areas of decreased thickness.
Figure 4:
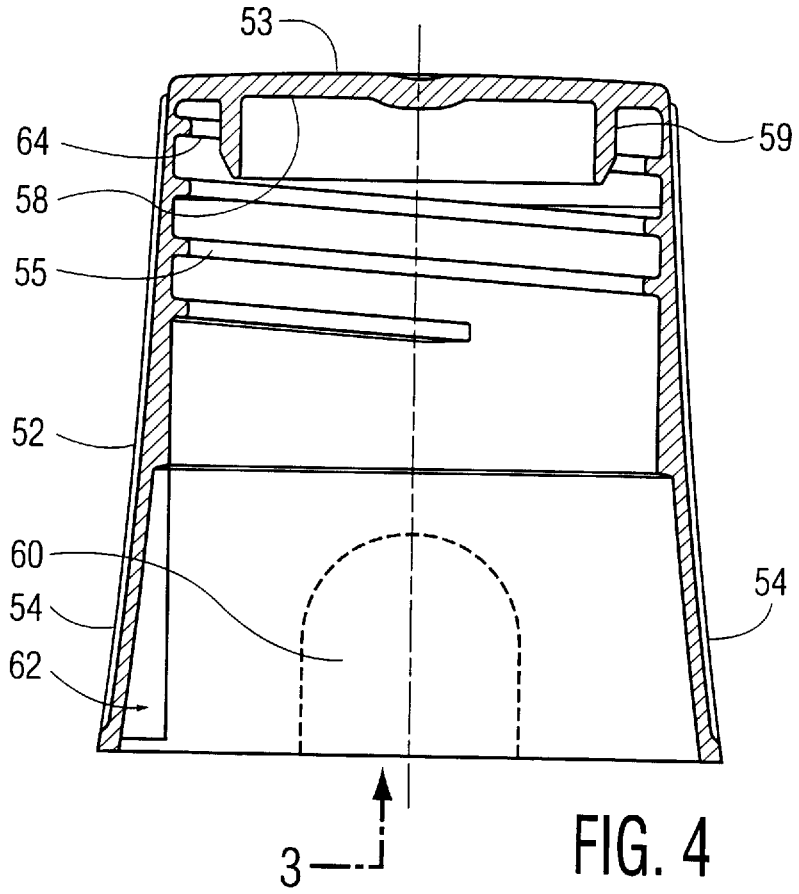
FIG. 4 is vertical cross-section of the closure of FIG. 3 along line 4—4.

FIGS. 3 and 4 disclose the structure of the closure. FIG. 3 is a bottom plan view of the closure 50. FIG. 4 is a cross-sectional view of the closure along line 4—4 of FIG. 3. This is the closure that will fit onto neck 38 of a container. The closure has outer cylindrical surface 52 depending from a top 53. The inner surface of the top carries gasket 58 and a seal flange 59. Between the seal flange 59 and sidewall 52 is space 64 which accepts the upper part of neck 38. This seals container aperture 42 of the container. Single start thread 55 secures the closure onto the container. Areas 54 are thinned areas of the closure to promote ease in flexing these parts of the closure sidewall 52 outwardly. Projection 62 is carried by the closure sidewall in the region of the thinned area. This projection 62 is aligned to interlock with projection 48 on the neck of the container. Areas 60 are two places where it is indicated that a person squeeze to have areas 54 extend outwardly and for projection 62 on the closure to be able to pass by projection 48 on the neck of the container. In this way, the closure can be removed from the container. FIG. 4 which is a cross-sectional view of the closure shows the closure in more detail.

Figure 5:
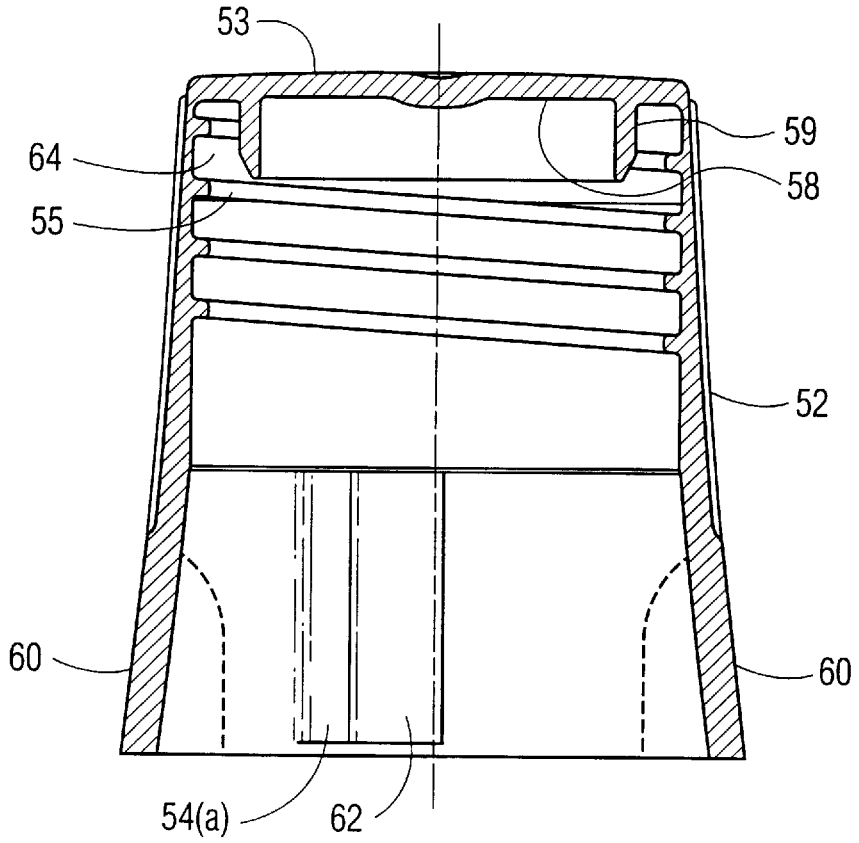
FIG. 5 is a vertical cross-section of the closure of FIG. 3 along line 5—5.

FIG. 5 is a cross-sectional view of the closure along line 5—5 of FIG. 3. This is a view transposed 90 degrees from the view of FIG. 4. In this view it is seen that areas 60 which are the finger press areas have a substantially greater thickness than the wall 54 where the projection is located as is shown in FIG. 4. Also, in this view the projection 62 is shown about 90 degrees from the finger press areas 60. The single start thread 55 also is shown in this view. At the top portion of the closure is seal 59 which contacts the inner surfact of the bottle neck. The upper perphery of the bottle neck fits into space 64 of between seal 59 and wall 52.

The key features are one locking means on each of the container and the closure and a single start thread on each of the container and the closure. In this way, the same closure can be used on common non-safety closure containers and on child resistant safety closure containers. The only difference that is needed is (i) a projection 48 on the shoulder of a container for mating with projection 62 on the closure sidewall for a safety closure arrangement and the lack of a projection 48 for no safety closure arrangement; or (ii) a projection 62 on the closure sidewall for mating with the container neck projection 48 for a safety closure arrangement and the lack of a projection 62 for no safety closure arrangement. When there is to be no safety closure arrangement either the projection 48 on the container neck or projection 62 on the closure is deleted. Of course for no safety closure arrangement both projections could be deleted.

In a preferred embodiment the projection 48 will be maintained on the container with the closure having projection 62 for a child resistant safety closure mode and no projection 62 when it is not to be a safely closure. The containers can be the same since if there is no locking projection on the closure the projection 48 on the container will fully clear the container without any squeezing or other action.

The use of a single start thread increases the utility of the closure since the same closure can be used for standard containers not using a child resistant safety closure and containers which use a child resistant safety closure. The only difference would be on the neck finish of the container. For a safety closure there would be a projection on the outer surface of the neck of the container to interact with the projection on the inner surface of the closure. When a safety closure is not required there would not be any projection on the closure to mate with the projection on the container or these would not be any projection on the surface of the neck of the container to mate with the projection on the closure. In these instances the closure can be freely removed from the container.

The present container and closure can be modified in various ways and yet be within the same concept of one cooperating locking means on the container and closure, and the use of a single start thread on the closure and on the container. All structures that are within the present concept are considered to be within the present invention.

What is claimed is:

1. A safety closure comprising a container having a neck, a dispensing end on said neck, a single start thread on said neck adjacent said dispensing end for the attachment of a closure, at least one flattened region extending axially on substantially an entire length of said neck, said flattened region interrupts said thread, only a single projection on an outer surface of said neck located below said single start thread, a single start thread on said closure, only a single projection on an inner surface of said closure and located below said single start thread of said closure and cooperating with said projection on said neck and at least one region for pressing inwardly whereby upon pressing said region inwardly distorting said closure in the region of said single projections to cause said closure to extend outwardly said single projections are in a clearance mode and pass by one another upon rotation of said closure in the removal direction.

2. A safety closure as in claim 1 wherein said single start thread on said neck surrounds said neck about 1.5 to about 3 times.

3. A safety closure as in claim 2 wherein said single start thread on said neck and said single start thread on said closure raise said closure up to about 3 mm to about 6 mm for each revolution of said closure on said neck.

4. A safety closure as in claim 1 wherein there are at least two flattened regions on said neck.

5. A safety closure as in claim 4 wherein said flattened region is located on said neck about 90° from said single projection on said neck.

6. A safety closure as in claim 1 wherein said flattened region is located on said neck about 90° from said single projection on said neck.

7. A safety closure as in claim 1 wherein said closure has at least one region that has a decreased thickness.

8. A safety closure as in claim 7 wherein said at least one region with a decreased thickness is located on said closure in the region of said single projection on said closure.

9. A safety closure as in claim 7 wherein there are at least two regions of a decreased thickness, each of such regions being about 180° apart.

10. A safety closure as in claim 1 wherein said closure has at least two areas for pressing inwardly.

11. A safety closure as in claim 1 wherein said at least one area for pressing inwardly is about 90 degrees from an at least one area of decreased thickness on said closure.

* * * * *